US011425515B1

(12) United States Patent
Carlile et al.

(10) Patent No.: US 11,425,515 B1
(45) Date of Patent: Aug. 23, 2022

(54) EAR-MOUNT ABLE LISTENING DEVICE WITH BAFFLED SEAL

(71) Applicant: Iyo Inc., Redwood City, CA (US)

(72) Inventors: Simon Carlile, San Francisco, CA (US); Neil Treat, Los Gatos, CA (US); Jason Rugolo, Mountain View, CA (US)

(73) Assignee: Iyo Inc., Redwood City, CA (US)

( * ) Notice: Subject to any disclaimer, the term of this patent is extended or adjusted under 35 U.S.C. 154(b) by 0 days.

(21) Appl. No.: 17/203,307

(22) Filed: Mar. 16, 2021

(51) Int. Cl.
*H04R 1/10* (2006.01)
*H04R 25/00* (2006.01)

(52) U.S. Cl.
CPC ..... *H04R 25/652* (2013.01); *H04R 1/1016* (2013.01); *H04R 2460/11* (2013.01)

(58) Field of Classification Search
CPC ..... H04R 1/10; H04R 1/1016; H04R 25/652; H04R 2225/025; H04R 2460/09; H04R 2460/11
See application file for complete search history.

(56) References Cited

U.S. PATENT DOCUMENTS 5,006,055 A 4/1991 Lebisch et al.
7,387,187 B2 6/2008 Widmer et al.
7,349,909 B2 7/2008 Widmer et al.
7,394,909 B1 * 7/2008 Widmer ..... H04R 25/658 381/328
7,757,400 B2 7/2010 Widmer et al.
8,031,900 B2 * 10/2011 Dyer ..... H04R 1/1016 381/328
8,340,335 B1 * 12/2012 Shennib ..... H04R 25/604 381/328
8,554,350 B2 10/2013 Keady et al.
9,004,223 B2 * 4/2015 Saltykov ..... H04R 25/656 181/135
9,020,176 B2 4/2015 Burns
(Continued)

FOREIGN PATENT DOCUMENTS

KR 10-1675016 B1 12/2016
KR 102227132 B1 * 3/2021

OTHER PUBLICATIONS

Hiipakka M., Measurement Apparatus and Modelling Techniques of Ear Canal Acoustics, Research Gate, Nov. 24, 2008, 94 pages.
(Continued)

*Primary Examiner* — Ryan Robinson
(74) *Attorney, Agent, or Firm* — Nicholson De Vos Webster & Elliott LLP

(57) ABSTRACT

An ear-mountable listening device includes a soft ear interface, an acoustic package, and electronics. The soft ear interface is shaped to house one or more components of the ear-mountable listening device. The soft ear interface has an outer surface that contacts a canal of an ear when the ear-mountable listening device is worn by the ear. The outer surface of the soft ear interface includes a plurality of baffles to form one or more channels for air or moisture to propagate through. The one or more channels extend from between a distal end and a proximal end of the soft ear interface. The proximal end of the soft ear interface extends to at least a first bend of the canal and the distal end of the soft ear interface contacts a concha of the ear when the ear-mountable listening device is worn.

24 Claims, 7 Drawing Sheets

(56) References Cited

U.S. PATENT DOCUMENTS

| | | | | |
|---|---|---|---|---|
| 9,479,859 | B2 | 10/2016 | Henry et al. | |
| 9,807,524 | B2 * | 10/2017 | Shennib | H04R 25/652 |
| 10,542,341 | B2 * | 1/2020 | Higgins | H04R 25/652 |
| 10,999,670 | B2 * | 5/2021 | Zalisk | H04R 1/1016 |
| 11,206,471 | B1 * | 12/2021 | Seo | H04R 1/1016 |
| 2008/0299339 | A1 | 12/2008 | Keady | |
| 2008/0300703 | A1 | 12/2008 | Widmer et al. | |
| 2014/0153761 | A1 * | 6/2014 | Shennib | H04R 25/652 381/328 |
| 2014/0286515 | A1 | 9/2014 | Bone et al. | |
| 2015/0222978 | A1 | 8/2015 | Murozaki | |
| 2017/0347211 | A1 * | 11/2017 | Naether | H04R 25/60 |
| 2019/0208304 | A1 | 7/2019 | Cohen et al. | |
| 2020/0275220 | A1 * | 8/2020 | Valenzuela | H04R 1/1016 |
| 2022/0070573 | A1 * | 3/2022 | Møller | H04R 25/60 |

OTHER PUBLICATIONS

International Search Report and Written Opinion, PCT App. No. PCT/US2022/020072, dated Jun. 29, 2022, 7 pages.

* cited by examiner

415

EAR-MOUNT ABLE LISTENING DEVICE WITH BAFFLED SEAL

TECHNICAL FIELD

This disclosure relates generally to the field of acoustic devices, and in particular but not exclusively, relates to ear-mountable listening devices.

BACKGROUND INFORMATION

Ear mounted listening devices include headphones, which are a pair of loudspeakers worn on or around a user's ears. Circumaural headphones use a band on the top of the user's head to hold the speakers in place over or in the user's ears. Another type of ear mounted listening device is known as earbuds or earpieces and include individual monolithic units that plug into the user's ear canal.

Both headphones and ear buds are becoming more common with increased use of personal electronic devices. For example, people use headphones to connect to their phones to play music, listen to podcasts, place/receive phone calls, or otherwise. However, headphone devices are currently not designed for all-day wearing since their presence blocks outside noises from entering the ear canal without accommodations to hear the external world when the user so desires. Thus, the user is required to remove the devices to hear conversations, safely cross streets, etc.

Hearing aids for people who experience hearing loss are another example of an ear mountable listening device. These devices are commonly used to amplify environmental sounds. While these devices are typically worn all day, they often fail to accurately reproduce environmental cues, thus making it difficult for wearers to localize reproduced sounds. As such, hearing aids also have certain drawbacks when worn all day in a variety of environments. Furthermore, conventional hearing aid designs are fixed devices intended to amplify whatever sounds emanate from directly in front of the user. However, an auditory scene surrounding the user may be more complex and the user's listening desires may not be as simple as merely amplifying sounds emanating directly in front of the user.

With any of the above ear mountable listening devices, monolithic implementations are common. These monolithic designs are not easily custom tailored to the end user, and if damaged, require the entire device to be replaced at greater expense. Accordingly, a dynamic and multiuse ear mountable listening device capable of providing all day comfort in a variety of auditory scenes is desirable.

BRIEF DESCRIPTION OF THE DRAWINGS

Non-limiting and non-exhaustive embodiments of the invention are described with reference to the following figures, wherein like reference numerals refer to like parts throughout the various views unless otherwise specified. Not all instances of an element are necessarily labeled so as not to clutter the drawings where appropriate. The drawings are not necessarily to scale, emphasis instead being placed upon illustrating the principles being described.

DETAILED DESCRIPTION

Figure 1A:
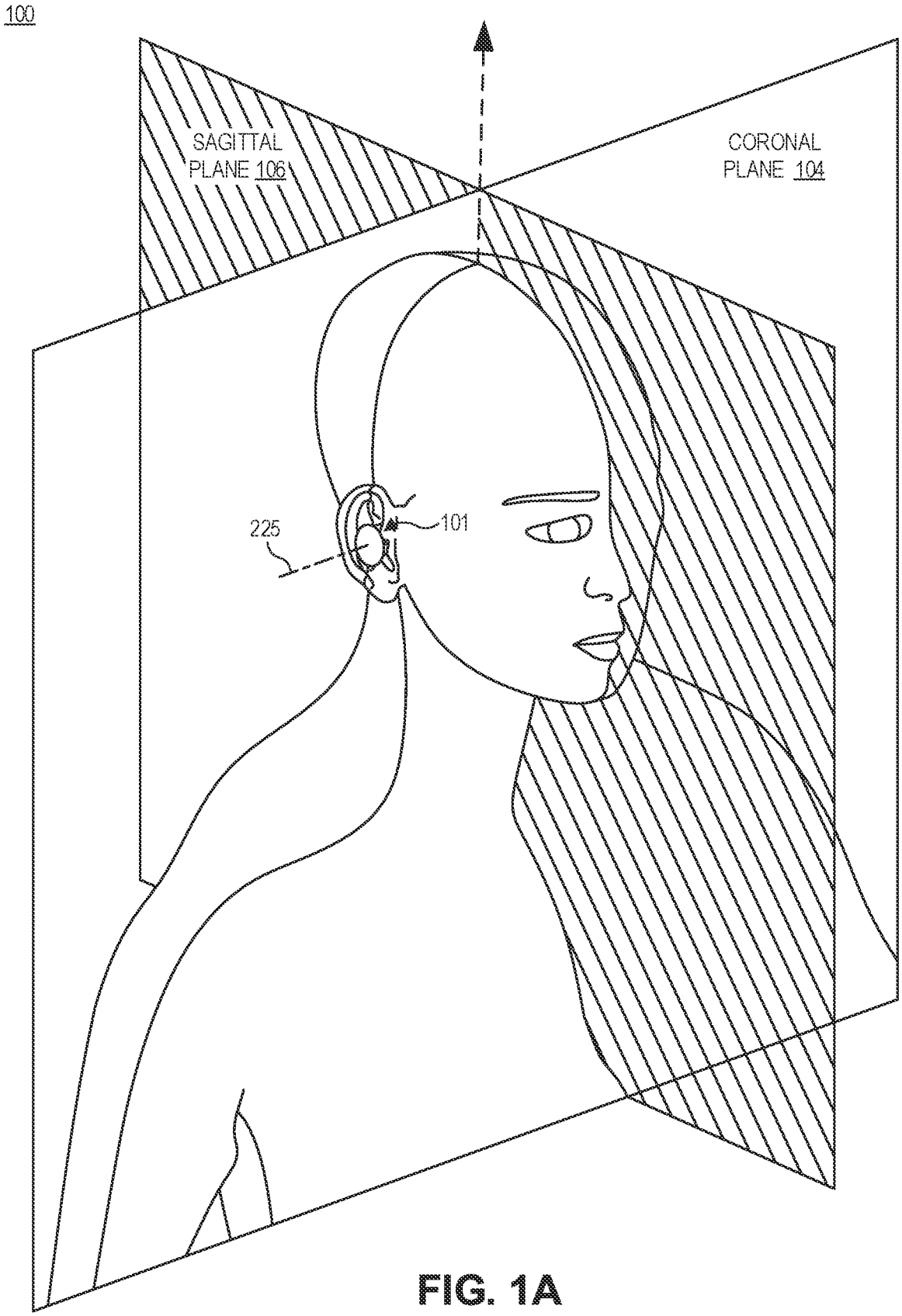
FIG. 1A illustrates a binaural listening system including an ear-mountable listening device when worn plugged into an ear canal, in accordance with an embodiment of the disclosure.

Embodiments of a system, apparatus, and method of operation for an ear-mountable listening device with baffled seal are described herein. In the following description numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Described herein are embodiments of a binaural listening system and/or ear-mountable listening device including a soft ear interface to provide high levels of acoustic attenuation along with proper management of temperature, moisture levels (e.g., humidity), and standing canal pressure when the system and/or device is inserted into or otherwise mounted to the ear (i.e., worn). Important conditions include maintaining not only a high level of comfort but good health of the outer ear via proper management of temperature, moisture, cerumen, and standing pressure (e.g., pressure within the ear canal) relative to the pressure in the middle ear. When traditional in-ear devices are worn, a seal may form that prevents pressure within the ear canal from equalizing with the pressure within the middle ear causing discomfort when wearing the device. It is appreciated that the pressure within the middle ear is typically comparable to ambient pressure (e.g., atmosphere pressure of the physical environment outside of the body of the user) due to the eustachian tube connecting the middle ear to the nasopharynx. Thus, the pressure of the ear canal can be substantially equalized with the pressure of the middle ear by matching the ambient pressure.

Embodiments of the disclosure include a soft ear interface that forms a baffled seal with the ear when the associated ear-mountable listening device is inserted, worn, or otherwise mounted to the ear. The baffled seal provided by the soft ear interface and/or other features described herein enables an acoustic seal that may provide high impedance (e.g., 30 dB or greater, 35 dB or greater, 40 dB or greater, or otherwise) of sound attenuation (e.g., passive noise isolation) while still allowing for pressure equalization and moisture/cerumen to be wicked or otherwise moved from inside the ear canal to outside and away from the device. The baffled seal is achieved, at least in part, by implementing a plurality of baffles formed on or from an outer surface of the soft ear interface that contacts the ear canal, concha, or other anatomical features of the ear when the ear-mountable listening device associated with the soft ear interface is inserted into the ear. The plurality of baffles forms one or more channels through which air, moisture, and/or cerumen may propagate. More specifically, the one or more channels form a tortuous pathway to attenuate sound while still allowing moisture and/or cerumen to be wicked away from the device.

Figure 1B:
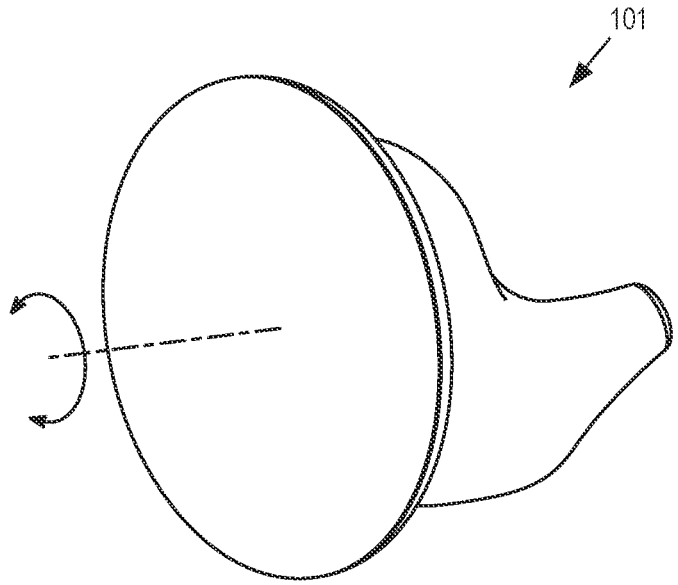
FIG. 1B is a front perspective illustration of the ear-mountable listening device, in accordance with an embodiment of the disclosure.
Figure 1C:
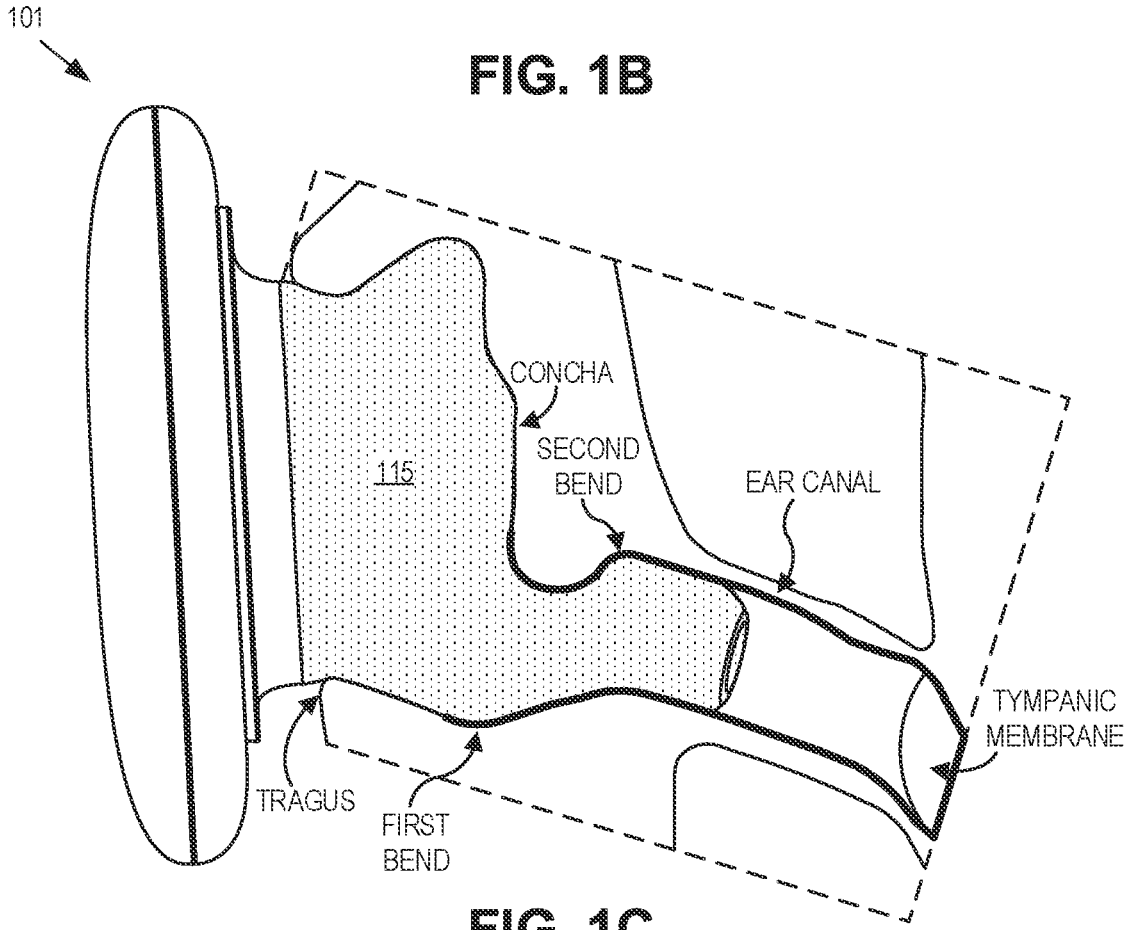
FIG. 1C is a side perspective illustration of the ear-mountable listening device when plugged into an ear canal, in accordance with an embodiment of the disclosure.

FIGS. 1A-1C illustrates a binaural listening system 100 including an ear-mountable listening device 101 shown when worn plugged into an ear canal, in accordance with an embodiment of the disclosure. The ear-mountable listening device 101 may be wirelessly coupled or otherwise paired with another instance of the ear-mountable listening device (not illustrated) to form the binaural listening system 100. In various embodiments, the ear-mountable listening device 101 (also referred to herein as an "ear device") is capable of facilitating a variety of auditory functions including wirelessly connecting to (and/or switching between) a number of audio sources (e.g., Bluetooth connections to personal computing devices, etc.) to provide in-ear audio to the user, controlling the volume of the real world (e.g., modulated noise cancellation and transparency), providing speech hearing enhancements, localizing environmental sounds for spatially selective cancellation and/or amplification, and even rendering auditory virtual objects (e.g., auditory assistant or other data sources as speech or auditory icons). Ear-mountable listening device 101 is amenable to all day wearing provided, at least in part, via a soft ear interface (e.g., soft ear interface 115 illustrated in FIG. 1C). When the user desires to block out external environmental sounds, the mechanical design and form factor along with active noise cancellation and passive noise isolation can provide substantial external noise dampening (e.g., 40 to 50 dB). When the user desires a natural auditory interaction with their environment, ear-mountable listening device 101 can provide near (or perfect) perceptual transparency by reassertion of the user's natural Head Related Transfer Function (HRTF), thus maintaining spaciousness of sound and the ability to localize sound origination in the environment.

As illustrated in FIG. 1C, when the ear-mountable listening device 101 is worn (e.g., inserted, at least partially, into an ear canal), the soft ear interface 115 extends beyond the first and second bends of the ear canal, which provides an acoustic seal of the ear canal. It is appreciated that the soft ear interface 115 may have a custom shape specifically tailored to substantially match a corresponding shape of the ear (e.g., including the concha and ear canal) for the wearer of the ear-mountable listening device 101. By having an overall shape tailored to the specific geometry of an individual user's ear the soft ear interface provides a conformal fit to the ear and holds the ear-mountable listening device 101 in place. Additionally, the plurality of baffles (see, e.g., baffles 450 illustrated in FIG. 4A and/or baffles 550 illustrated in FIG. 5) of the soft ear interface 115 provide enhanced comfort of the ear-mountable listening device 101 by promoting propagation of air, moisture, and/or cerumen. It is appreciated that in other embodiments, the soft ear interface 115 may not extend beyond the second bend of the ear canal or even the first bend of the ear canal depending on a configuration of the soft ear interface 115 and/or more generally the ear-mountable listening device 101.

Figure 2:
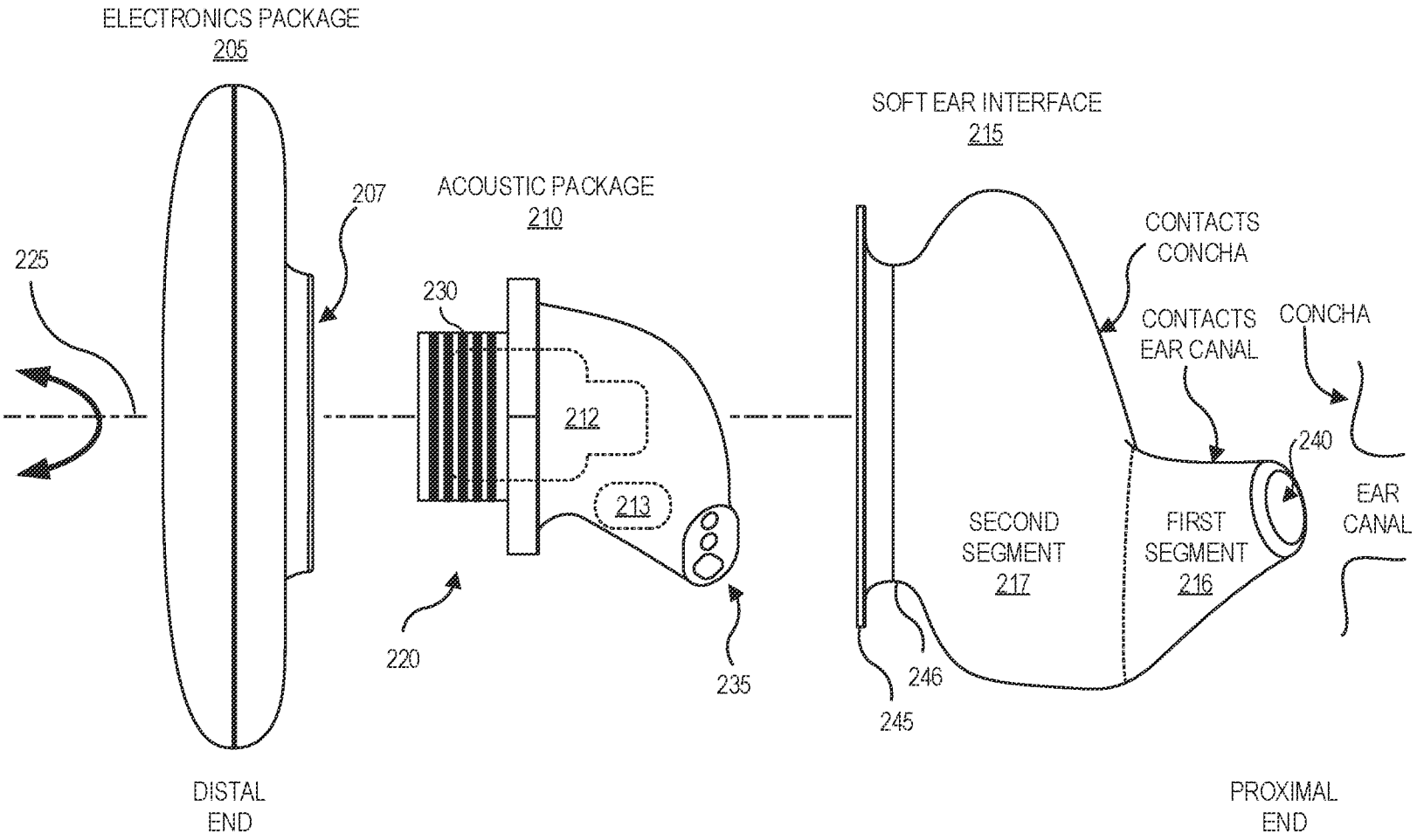
FIG. 2 is an exploded view illustration of the ear-mountable listening device, in accordance with an embodiment of the disclosure.

FIG. 2 illustrates an exploded view of ear-mountable listening device 201, in accordance with an embodiment of the disclosure. Ear-mountable listening device 201 is one possible implementation of ear-mountable listening device 101 illustrated in FIGS. 1A-1C. Referring back to FIG. 2, ear-mountable listening device 201 has a modular design including an electronics package 205, an acoustic package 210, and a soft ear interface 215. The three components are separable by the end-user allowing for any one of the components to be individually replaced should it be lost or damaged. The illustrated embodiment of electronics package 205 has a puck-like shape and includes an array of microphones for capturing external environmental sounds along with electronics disposed on a main circuit board for data processing, signal manipulation, communications, user interfaces, and sensing. In some embodiments, the main circuit board has an annular disk shape with a central hole to provide a compact, thin, or close-into-the-ear form factor.

The illustrated embodiment of acoustic package 210 includes multiple transducers or speakers 212, and in some embodiments, an internal microphone 213 for capturing user noises incident via the ear canal, along with electromechanical components of a rotary user interface. A distal end of acoustic package 210 may include a cylindrical post 220 that slides into and couples with a cylindrical port 207 on the proximal side of electronics package 205. In embodiments where the main circuit board within electronics package 205 is an annular disk, cylindrical port 207 aligns with the central hole. The annular shape of the main circuit board and cylindrical port 207 facilitate a compact stacking of speakers 212 with the microphone array within electronics package 205 directly in front of the opening to the ear canal enabling a more direct orientation of speakers 212 to the axis of the auditory canal. Internal microphone 213 may be disposed within acoustic package 210 and electrically coupled to the electronics within electronics package 205 for audio processing (illustrated), or disposed within electronics package 205 with a sound pipe plumbed through cylindrical post 220 and extending to one of the ports 235 (not illustrated). Internal microphone 213 may be shielded and oriented to focus on user sounds originating via the ear canal. Additionally, internal microphone 213 may also be part of an audio feedback control loop for driving cancellation of the ear occlusion effect.

Post 220 may be held mechanically and/or magnetically in place while allowing electronics package 205 to be rotated about central axial axis 225 relative to acoustic package 210 and soft ear interface 215. This rotation of electronics package 205 relative to acoustic package 210 implements a rotary user interface. The mechanical/magnetic connection facilitates rotational detents (e.g., 8, 16, 32) that provide a force feedback as the user rotates electronic package 205 with their fingers. Electrical trace rings 230 disposed circumferentially around post 220 provide electrical contacts for power and data signals communicated between electronics package 205 and acoustic package 210. In other embodiments, post 220 may be eliminated in favor of using flat circular disks to interface between electronics package 205 and acoustic package 210.

Figure 4A:
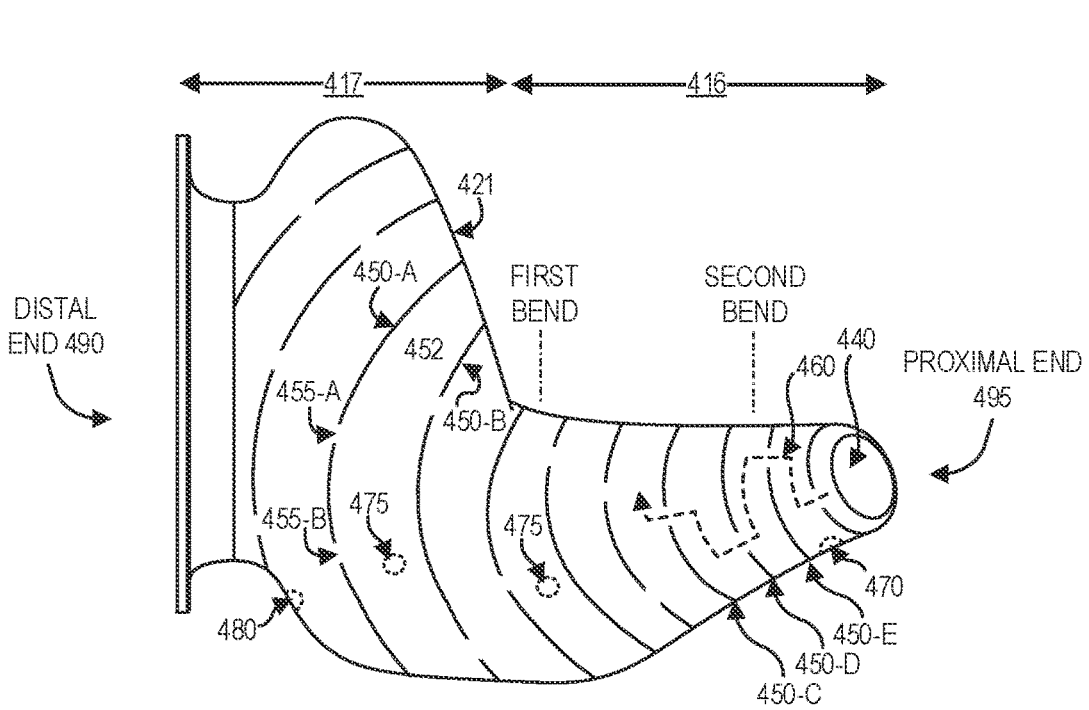
FIG. 4A illustrates an example soft ear interface with a plurality of baffles, in accordance with an embodiment of the disclosure.
Figure 5:
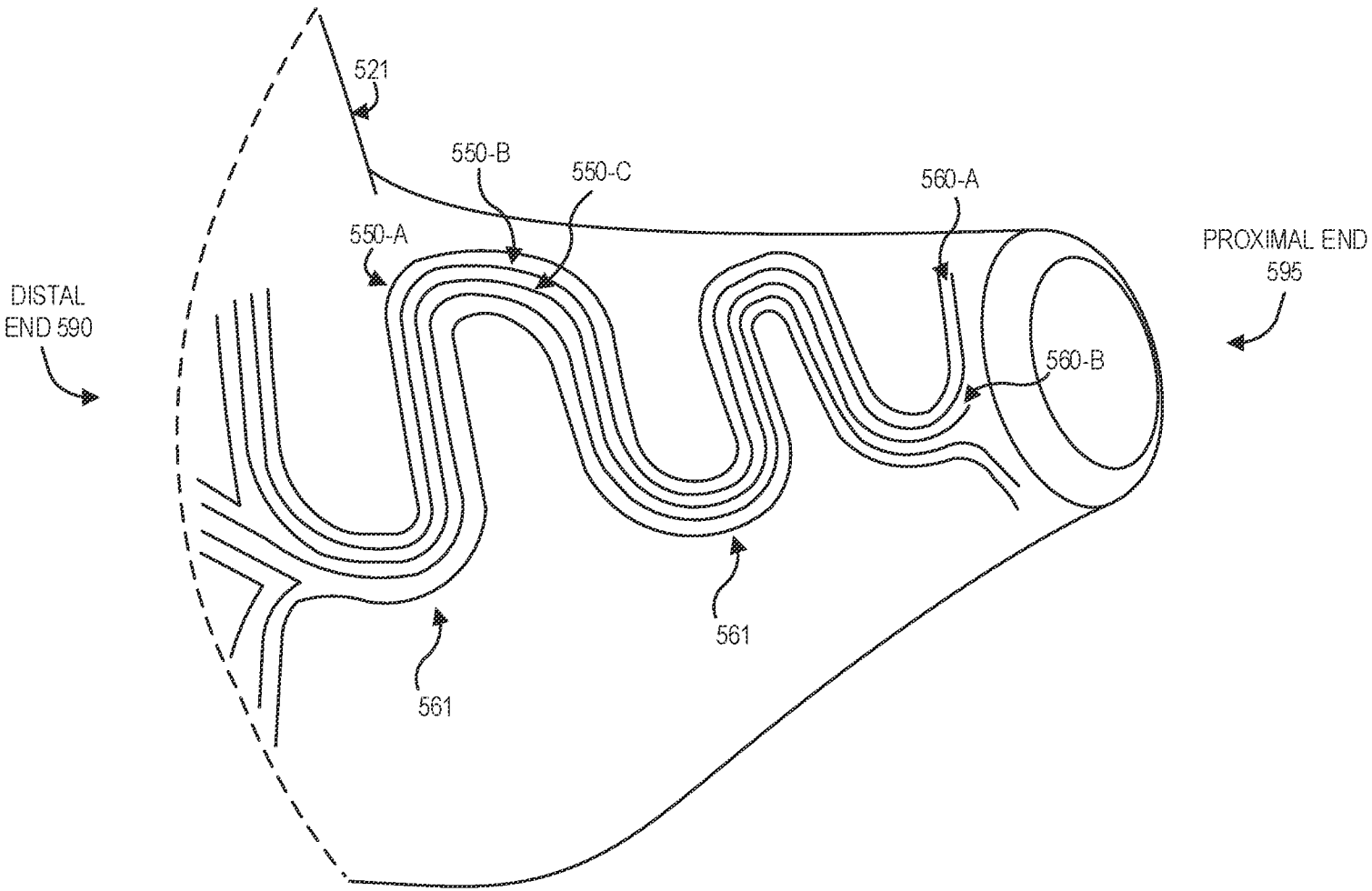
FIG. 5 illustrates an example soft ear interface with a plurality of baffles arranged in a serpentine pattern, in accordance with an embodiment of the disclosure.

Soft ear interface 215 is fabricated of a flexible material (e.g., silicone, flexible polymers, any other material or materials amenable to be at least partly compressible or flexible, or combinations thereof) and includes a first segment 216 shaped to be inserted into an ear canal of an ear and a second segment 217 shaped to contact or otherwise be inserted into a concha of the ear of the user to mechanically hold ear-mountable listening device 201 in place (e.g., via friction or elastic force fit). Soft ear interface 215 may be a custom molded piece (or fabricated in a limited number of sizes) to accommodate different concha and ear canal sizes/shapes. Soft ear interface 215 provides a comfortable fit while mechanically sealing the ear to dampen or attenuate direct propagation of external sounds into the ear canal. Soft ear interface 215 includes an internal cavity disposed, at least in part, in the second segment 217 and is shaped to house one or more components (e.g., acoustic package 210) of the ear-mountable listening device 201 and securely holds the one or more components therein. In some embodiments, the specific shape of the cavity formed by the soft ear interface 215 aligns ports 235 with in-ear aperture 240 to deliver audio emitted from the acoustic package 210 to the ear. A flexible flange 245 seals soft ear interface 215 to the backside of electronics package 205 encasing acoustic package 210 and keeping moisture away from acoustic package 210. In some embodiments, one or more of a plurality of baffles (e.g., as illustrated in FIG. 4A and FIG. 5) disposed on an outer surface of the soft ear interface 215 may extend to taper 246. Though not illustrated, in some embodiments, the distal end of acoustic package 210 may include a barbed ridge encircling ports 235 that friction fit or "click" into a mating indent feature within soft ear interface 215.

Referring back to FIG. 1A, which illustrates how ear-mountable listening device 101 is held by, mounted to, or otherwise disposed in the user's ear. As illustrated, soft ear interface 215 is shaped to hold ear-mountable listening device 101 with central axial axis 225 substantially falling within (e.g., within 20 degrees) a coronal plane 104. As is discussed in greater detail below, an array of microphones extends around central axial axis 225 in a ring pattern that substantially falls within a sagittal plane 106 of the user. When ear-mountable listening device 101 is worn, electronics package 205 is held close to the pinna of the ear and aligned along, close to, or within the pinna plane. Holding electronics package 205 close into the pinna not only provides a desirable industrial design (relative to further out protrusions), but may also has less impact on the user's HRTF or more readily lend itself to a definable/characterizable impact on the user's HRTF, for which offsetting calibration may be achieved. As mentioned, the central hole in the main circuit board along with cylindrical port 207 facilitate this close in mounting of electronics package 205 despite mounting speakers 212 directly in front of the ear canal in between electronics package 205 and the ear canal along central axial axis 225.

Figure 3:
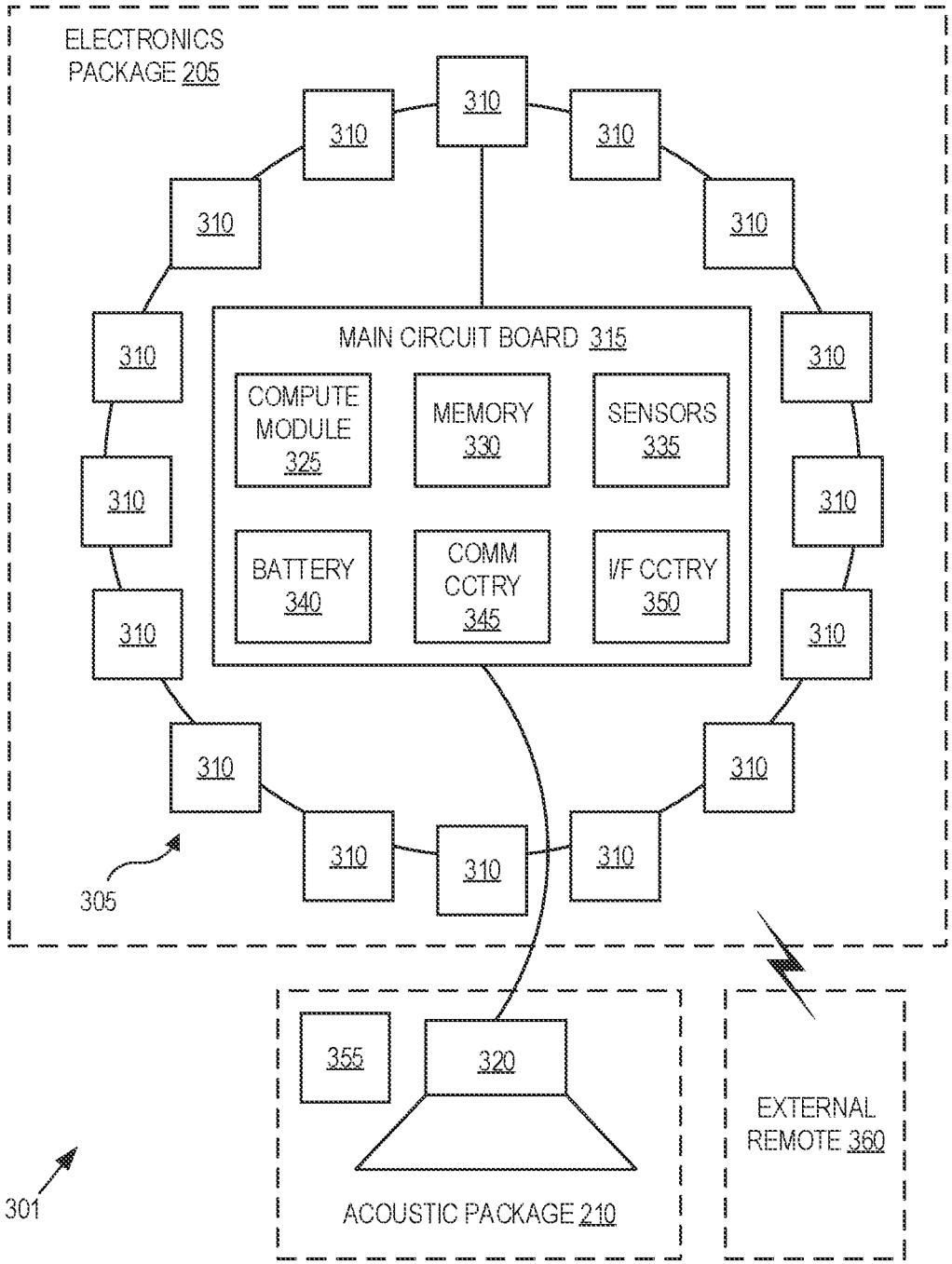
FIG. 3 is a block diagram illustrating select functional components of the ear-mountable listening device, in accordance with an embodiment of the disclosure.

FIG. 3 is a block diagram illustrating select functional components 300 of ear-mountable listening device 301, in accordance with an embodiment of the disclosure. Ear-mountable listening device 301 is one possible implementation of ear-mountable listening device 101 illustrated in FIGS. 1A-IC and ear-mountable listening device 201 illustrated in FIG. 2. The illustrated embodiment of components in FIG. 3 includes an adaptive phased array 305 of microphones 310 and a main circuit board 315 disposed within electronics package 205 while speaker 320 are disposed within acoustic package 210. Main circuit board 315 includes various electronics disposed thereon including a compute module 325, memory 330, sensors 335, battery 340, communication circuitry 345, and interface circuitry 350. The illustrated embodiment also includes an internal microphone 355 disposed within acoustic package 210. An external remote 360 (e.g., handheld device, smart ring, etc.) may be wirelessly coupled to ear-mountable listening device 101 (or binaural listening system 100) via communication circuitry 345. Although not illustrated, acoustic package 210 may also include some electronics for digital signal processing (DSP), such as a printed circuit board (PCB) containing a signal decoder and DSP processor for digital-to-analog (DAC) conversion and EQ processing, a bi-amped crossover, and various auto-noise cancellation and occlusion processing logic.

In one embodiment, microphones 310 are arranged in a ring pattern (e.g., circular array, elliptical array, etc.) around a perimeter of main circuit board 315. Main circuit board 315 itself may have a flat disk shape, and in some embodiments, is an annular disk with a central hole. In the case of a binaural listening system, protrusion of electronics package 205 may extend significantly out past the pinna plane and may even distort the natural time of arrival of the sounds to each ear and further distort spatial perception and the user's HRTF potentially beyond a calibratable correction. Fashioning the disk as an annulus (or donut) enables protrusion of the driver of speaker 320 (or speakers 212) through main circuit board 315 and thus allow a more direct orientation/alignment of speaker 320 with respect to the entrance of the auditory canal.

Microphones 310 may each be disposed on their own individual microphone substrates. The microphone port of each microphone 310 may be spaced in substantially equal angular increments about central axial axis 225. In FIG. 3, sixteen microphones 310 are equally spaced; however, in other embodiments, more or less microphones may be distributed (evenly or unevenly) in the ring pattern about central axial axis 225.

Compute module 325 may include a programmable microcontroller that executes software/firmware logic stored in memory 330, hardware logic (e.g., application specific integrated circuit, field programmable gate array, etc.), or a combination of both. Although FIG. 3 illustrates compute module 325 as a single centralized resource, it should be appreciated that compute module 325 may represent multiple compute resources disposed across multiple hardware elements on main circuit board 315 and which interoperate to collectively orchestrate the operation of the other functional components. For example, compute module 325 may execute logic to turn ear-mountable listening device 101 on/off, monitor a charge status of battery 340 (e.g., lithium ion battery, etc.), pair and unpair wireless connections, switch between multiple audio sources, execute play, pause, skip, and volume adjustment commands received from interface circuitry 350, commence multi-way communication sessions (e.g., initiate a phone call via a wirelessly coupled phone), control volume of the real-world environment passed to speaker 320 (e.g., modulate noise cancellation and perceptual transparency), enable/disable speech enhancement modes, enable/disable smart volume modes (e.g., adjusting max volume threshold and noise floor), or otherwise. In some embodiments, compute module 325 may operably configure (e.g., variably power) a plurality of electroacoustic transducers (e.g., loudspeakers, tweeters, woofers, and/or combinations thereof) included in the acoustic package 210 to emit audio in response to an audio signal (e.g., from one or more audio sources).

Sensors 335 may include a variety of sensors such as an inertial measurement unit (IMU) including one or more of a three axis accelerometer, a magnetometer (e.g., compass), or a gyroscope. Communication interface 345 may include one or more wireless transceivers including near-field magnetic induction (NFMI) communication circuitry and antenna, ultra-wideband (UWB) transceivers, a WiFi transceiver, a radio frequency identification (RFID) backscatter tag, a Bluetooth antenna, or otherwise. Interface circuitry 350 may include a capacitive touch sensor disposed across the distal surface of electronics package 205 to support touch commands and gestures on the outer portion of the puck-like surface, as well as a rotary user interface (e.g., rotary encoder) to support rotary commands by rotating the puck-like surface of electronics package 205. A mechanical push button interface operated by pushing on electronics package 205 may also be implemented.

FIG. 4A illustrates an example soft ear interface 415 with a plurality of baffles 450, in accordance with an embodiment of the disclosure. Soft ear interface 415 is one possible implementation of soft ear interface 115 of ear-mountable listening device 101 illustrated in FIGS. 1A-1C and/or soft ear interface 215 illustrated in FIG. 2. As shown in FIG. 4A, soft ear interface 415 includes a first segment 416 and a second segment 417 extending from the first segment 416. The first segment 416 and second segment 417 collectively form an outer surface 421 of the soft ear interface 415 that may contact the concha and canal of an ear when mounted to an ear of a user (e.g., when the ear-mountable listening device 101 is inserted into the ear of the user as illustrated in FIG. 1B). As shown in FIG. 4A, a proximal end 495 of the soft ear interface 415, corresponding to aperture 440, extends beyond the first and second bend of the ear canal when the soft ear interface 415 is inserted into the ear of the user. Advantageously, by extending to the second bend of the ear canal, the attenuation of noise (e.g., passive noise isolation) provided by the soft ear interface 415 is enhanced while also enabling the propagation of sound via an acoustic package (e.g., acoustic package 210 illustrated in FIG. 2) through the aperture 440. However, it is appreciated that in other embodiments the soft ear interface 415 may not extend beyond the second bend of the ear canal, the first bend of the ear canal, or both when inserted into or otherwise mounted to the ear.

As illustrated in FIG. 4A, the outer surface 421 of the soft ear interface 415 forms a plurality of baffles 450 to form one or more channels (e.g., first channel 460) for air or moisture to propagate through. Each baffle included in the plurality of baffles 450 corresponds to a wall, ridge, groove, facet, step, bump, striation, or any other feature that otherwise corresponds to a change in height or thickness of the soft ear interface 450 that deflects, checks, or regulates the propagation of sound, air, moisture, cerumen, or combinations thereof. For example, channel 452 is formed by adjacent baffles 450-A and 450-B, which provide a pathway extending circumferentially around the outer surface 421 of the soft ear interface 415. Accordingly, the plurality of baffles 450 structures the soft ear interface 415 to wick, move, or otherwise allow moisture and/or cerumen to propagate from the proximal end 495 towards the distal end 490, which mitigates their accumulation proximate to the boundaries where the soft ear interface 415 meets the ear canal while still allowing for pressure equalization within the ear canal (e.g., middle ear pressure) with respect to an ambient pressure. The mitigation of moisture and/or cerumen accumulation at the ear canal combined with pressure equalization may enhance comfort to enable wearing the ear-mountable listening device associated with the soft ear interface 415 for extended periods of time.

The illustrated embodiment shows individual baffles included in the plurality of baffles 450 extending circumferentially around the outer surface 421 of the soft ear interface 415 and collectively along a longitudinal direction of the soft ear interface 415 (e.g., a direction extending from a midpoint of the proximal end 495 to a midpoint of the distal end 490). However, in other embodiments, the plurality of baffles 450 may not extend the full length of the soft ear interface 415. In one embodiment, the plurality of baffles 450 may only be present within the first segment 416 of the soft ear interface 415 (e.g., the plurality of baffles 450 may extend from the proximal end 495 to where the soft ear interface 415 transitions from the first segment 416 to the second segment 417). In other words, the plurality of baffles 450 may be distributed on the outer surface 421 of the soft ear interface 415 such that individual baffles contact the ear canal, but do not contact other segments of the ear (e.g., the concha) when the soft ear interface 415 is inserted in the ear. In another embodiment, the first channel 460 included in the one or more channels formed by the plurality of baffles 450 has a length greater than a longitudinal length of the soft ear interface 415 that spans from the proximal end 495 to the distal end 490. In the same or other embodiments, the first channel 460 and/or other channels included in the one or more channels formed by the plurality of baffles 450 may terminate proximate to a tragus, concha, and/or saddle point of the ear when the soft ear interface 415 is inserted in the ear to move moisture and/or cerumen formed within the ear canal to outside of the ear canal via capillary action, diffusion, evaporation, or other means.

In the embodiment illustrated in FIG. 4A, the plurality of baffles 415 include or otherwise form embossed rings extending, at least in part, circumferentially around the soft ear interface 415. In some embodiments, the embossed rings are open rings with corresponding gaps that each correspond to an opening for the one or more channels to transition between adjacent rings. More specifically, the corresponding gap of a given ring is representative of a break in said ring. For example, baffle 450-A forms a discontinuous ring that extends circumferentially around the soft ear interface 415 and includes a first gap 455-A and a second gap 455-B such that the ring formed by baffle 450-A does not extend continuously around the soft ear interface 415. The multiple gaps of baffle 450-A allows for divergence of the one or more channels. However, in other embodiments, each of the embossed rings may have a singular gap such that there is a single continuous and tortuous pathway or channel that extends between the proximal end 495 and the distal end 490. In the illustrated embodiment, the corresponding gaps of adjacent rings (e.g., formed by baffles 450-C, 450-D, and 450-E) are offset from one another such that there is not a straight line path between any three successive rings included in the embossed rings (e.g., as illustrated by first channel 460 having multiple turns to extend from baffle 450-E to baffle 450-C). In some embodiments, a separation distance between adjacent rings formed by the plurality of baffles 450 is uniform and is less than 1 mm, 0.5 mm, 0.1 mm, or any other pre-determined threshold separation distance. It is appreciated that reducing the separation distance between the adjacent rings may promote capillary action within the one or more channels. In other embodiments the separation distance between the adjacent rings may be non-uniform (e.g., randomly distributed below a threshold value), uniformly varying (e.g., increasing linearly from the proximal end 495 to the distal end 490 or vice versa), non-uniformly varying (e.g., increasing non-linearly from the proximal end 495 to the distal end 490 or vice versa), or otherwise.

As illustrated in FIG. 4A, the embossed rings formed by the plurality of baffles 450 include a first ring (e.g., baffle 450-E), a second ring (e.g., baffle 450-C), and a third ring (e.g., baffle 450-A). When the soft ear interface 415 is inserted into the ear, the second bend of the ear canal is disposed between the first ring and the second ring. Similarly, the first bend of the ear canal is disposed between the second ring and the third ring. In some embodiments, there may be a plurality of rings disposed beyond the second bend of the ear canal (e.g., disposed between the second bend and the tympanic membrane) when the soft ear interface 415 is worn. The soft ear interface 415 is further shaped to include at least one desiccant channel (e.g., desiccant channel 472 illustrated in FIG. 4F) that includes a first opening 470 and a second opening 480 at the outer surface 421. As illustrated, the first opening 470 is disposed proximate to the proximal end 495 and the second opening 480 is disposed proximate to the distal end 490. In other words, the first opening 470 and the second opening 480 define where the at least one desiccant channel initiates and terminates. The soft ear interface 415 is further structured to include a plurality of collection points 475, which couples the outer surface 421 of the soft ear interface 415 to the at least one desiccant channel. As illustrated, the plurality of collection points 475 are disposed between the first opening 470 and the second opening 480 on the outer surface 421 of the soft ear interface 415. It is appreciated that in some embodiments, the second opening 480 is disposed proximate to the tragus of the ear and the first opening 470 is disposed proximate to the second bend of the ear when the soft ear interface 415 is inserted in the other. However, in other embodiments the first opening 470 and the second opening 480 may be disposed in different positions relative to the anatomical structure of the ear.

Figure 4B:
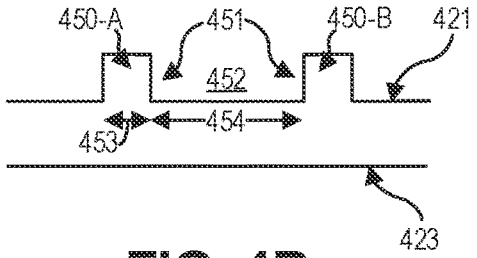
FIG. 4B illustrates a cross-sectional view of a portion of the soft ear interface illustrated in FIG. 4A, in accordance with an embodiment of the disclosure.

FIG. 4B illustrates a cross-sectional view of a portion of the soft ear interface 415 illustrated in FIG. 4A that includes baffle 450-A and 450-B, in accordance with an embodiment of the disclosure. As illustrated, the thickness of the soft ear interface 415 changes (e.g., based on the outer surface 421 and the inner surface 423 of the soft ear interface 415) to form ridges 451 defined by baffles 450-A and 450-B, which are separated from one another by separation distance 454 to form channel 452. In some embodiments, individual baffles included in the plurality of baffles 450 may have a width 453, which is less than, equal to, or greater than the separation distance 454 of the channel 452. In one or more embodiments, the width 453 and the separation distance 454 between adjacent baffles are both less than 1 mm. In another embodiment, the width 453 of a given baffle may be less than the separation distance 454 between adjacent baffles included in the plurality of baffles 450. For example, the width 453 may be less than 1 mm while the separation distance 454 may be greater than 1 mm. In some embodiments, the plurality of baffles 450 may be structured or otherwise arranged to promote wicking or capillarity of moisture and/or cerumen while still maintaining a high impedance acoustic seal when the soft ear interface is inserted in the ear for specific frequencies (e.g., audible frequencies up 16 kHz). More specifically, the one or more channels formed by the plurality of baffles 450 may have a cross-sectional area and length sufficient to contribute to acoustic resistance of the specific frequencies. In some embodiments, this may be achieved via submillimeter width of the one or more channels. As described in relation to FIG. 4A, the plurality of baffles 450 (e.g., baffle 450-A and/or 450-B) may form or otherwise include embossed rings. As illustrated, the embossed rings correspond to a protrusion from the outer surface 421. However, in the same or other embodiments, the embossed rings may correspond to depressions into the outer surface 421. As illustrated in FIG. 4B, the plurality of baffles 450 may form a step profile in which the thickness of the soft ear interface 415 abruptly changes. In the same or other embodiments, the thickness may change linearly, non-linearly, or otherwise.

Figure 4C:
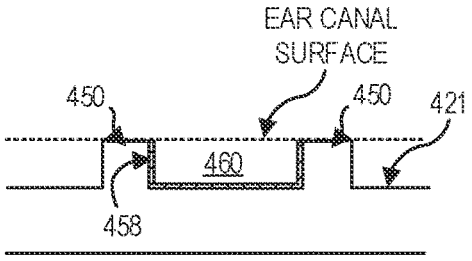
FIG. 4C illustrates a cross-sectional view of a portion of the soft ear interface illustrated in FIG. 4A that includes the plurality of baffles and optional coating when the soft ear interface is inserted in the ear, in accordance with an embodiment of the disclosure.

FIG. 4C illustrates a cross-sectional view of a portion of the soft ear interface 415 illustrated in FIG. 4A that includes the plurality of baffles 450 and optional coating 458 when the soft ear interface 415 is inserted in the ear, in accordance with an embodiment of the disclosure. As illustrated, when the soft ear interface 415 is inserted in the ear, at least a portion of the plurality of baffles 450 (e.g., baffles 450-C, 450-D, and 450-E illustrated in FIG. 4A) contacts the ear canal, which forms an occlusive fit of the ear-mountable listening device to the ear such that the one or more channels (e.g., channel 460) are sealed by the ear. Advantageously, the occlusive fit of the soft ear interface 415 to the ear combined with the continuous and/or tortuous pathway formed by the one or more channels provide a high impedance barrier to sound waves. In other words, noise propagating through the one or more channels will be attenuated to enhance passive noise isolation of the ear-mountable listening device.

In some embodiments, regions of the outer surface 421 that form the one or more channels (e.g., channel 460) may be coated or otherwise treated with one or more hydrophilic materials (e.g., polymers or other molecules containing polar or charged functional groups, hydrogels, self-assembled monolayers, and the like) to cause the surface energy of the regions to increase such that they are hydrophilic (e.g., water contact angle is less than 90°). In other embodiments, the entire outer surface 421 of the soft ear interface 415 may be coated, treated, or otherwise formed of hydrophilic materials to promote capillary action. In some embodiments, the soft ear interface 415 may be coated, treated, or otherwise formed from a fluoropolymer (e.g., stretched polytetrafluorethylene, expanded polytetrafluorethylene, or otherwise) to enhance moisture resistance of the soft ear interface 415.

Figure 4D:
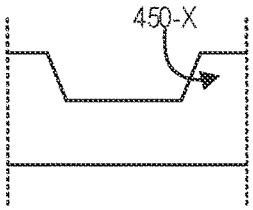
FIG. 4D and FIG. 4E illustrate cross-sectional views of example baffles, which may be included in the plurality of baffles of the soft ear interface illustrated in FIG. 4A, in accordance with an embodiment of the disclosure.
Figure 4E:
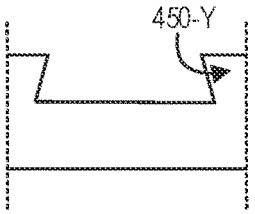

FIG. 4D and FIG. 4E illustrate cross-sectional views of example baffles 450-X and 450-Y, respectively, which may be included in the plurality of baffles 450 of the soft ear interface 415 illustrated in FIG. 4A, in accordance with an embodiment of the disclosure. As illustrated, the plurality of baffles 450 do not necessarily form an abrupt step profile, but instead may include baffles that form descending or ascending step profiles in which the separation distance along a thickness of the channel decreases or increases in a linear or non-linear manner as shown in FIG. 4D and FIG. 4E. In the same or other embodiment, the plurality of baffles 450 may have uniform profiles (e.g., each of the plurality of baffles 450 may have a substantially identical step profile), while in other embodiments a number of different profiles may be utilized (e.g., any combination of abrupt, linear, or non-linear step profiles).

Figure 4F:
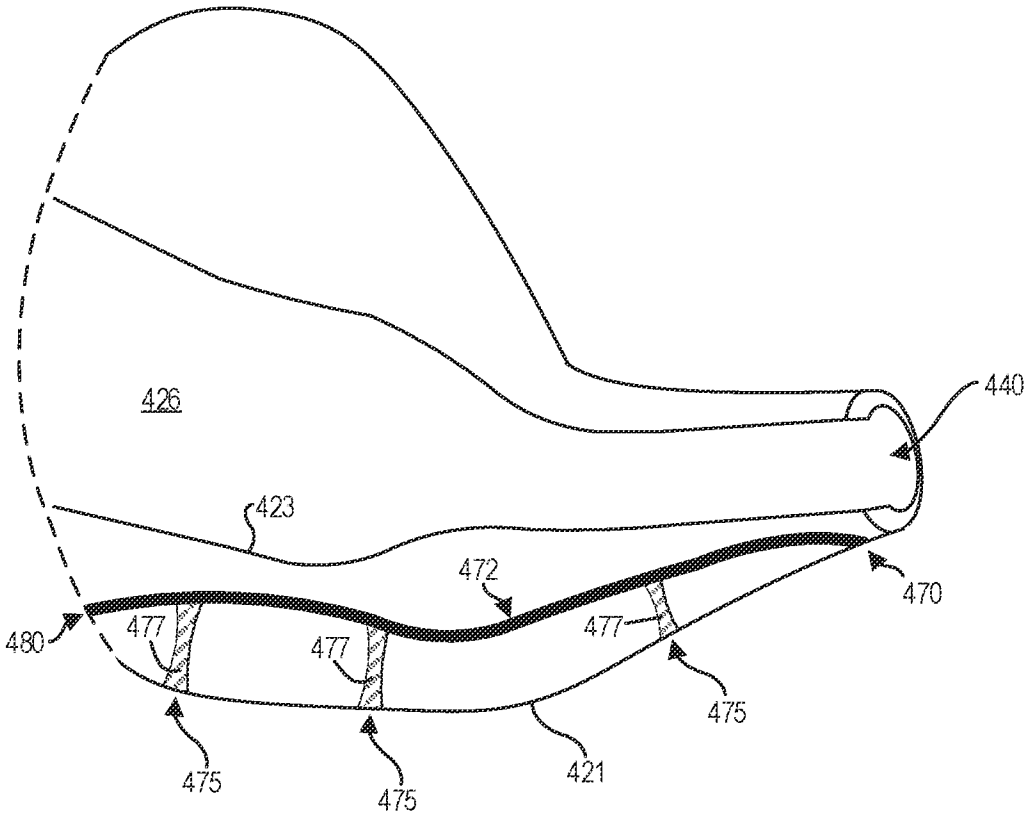
FIG. 4F illustrates a cross-sectional view of the soft ear interface including at least one desiccant channel, in accordance with an embodiment of the disclosure.

FIG. 4F illustrates a cross-sectional view of the soft ear interface 415 including at least one desiccant channel 472, in accordance with an embodiment of the disclosure. As illustrated and described in relation to FIG. 4A, the soft ear interface 415 includes desiccant channel 472 disposed internally within the soft ear interface 415 (e.g., between the outer surface 421 and the inner surface 423. The desiccant channel 472 includes the first opening 470 and the second opening 480 respectively disposed proximate to the proximal end and the distal end of the soft ear interface 415. In some embodiments, the second opening 480 is disposed proximate to a tragus of the ear when the ear-mountable listening device associated with the soft ear interface 415 is worn or otherwise mounted to the ear. The desiccant channel 472 forms an internal channel to the soft ear interface for internally collecting and transferring moisture and/or cerumen towards the second opening 480 (e.g., outside the ear canal). In some embodiments, the desiccant channel 472 may be coated or otherwise treated with one or more hydrophilic materials (e.g., polymers or other molecules containing polar or charged functional groups, hydrogels, self-assembled monolayers, and the like) to cause the surface energy of the regions to increase such that they are hydrophilic (e.g., water contact is angle less than 90°).

It is appreciated that while only a singular continuous desiccant channel 472 is shown in FIG. 4F, in other embodiment additional desiccant channels may also be included in the at least one desiccant channel. For example, there may be a plurality of desiccant channels, including desiccant channel 472, disposed between the outer surface 421 and the inner surface 423. In one embodiment, the plurality of desiccant channels may be coupled to one another or otherwise interconnected. In the same or other embodiments, a longitudinal length of the desiccant channel 472 is less than a pathway length of the one or more channels (e.g., channel 460 illustrated in FIG. 4A) formed from the plurality of baffles (e.g., plurality of baffles 450).

As illustrated in FIG. 4F, the soft ear interface 415 is further shaped or structured to include a plurality of collection points 475, disposed between the first opening 470 and the second opening 480, that couple the outer surface 421 of the soft ear interface 415 to desiccant channel 472. Each of the plurality of collection points 475 form a corresponding secondary channel 477 extending from the outer surface to the desiccant channel 472. The plurality of collection points 475 and corresponding secondary channels 477 may further aid with propagation of moisture and/or ceremony out of the ear canal to promote extended comfort. In some embodiments, at least one of the corresponding secondary channels 477 is interconnected with the one or more channels formed by the plurality of baffles (e.g., collection point 475, which is coupled to a corresponding secondary channel 477, is disposed in the channel 452 formed by baffle 450-A and 450-B as illustrated in FIG. 4A).

It is noted that in the illustrated embodiment, soft ear interface 415 is further shaped to house one or more components of the ear-mountable listening device (e.g., acoustic package 210 illustrated in FIG. 2) via a cavity 426, such that audio may be emitted from the acoustic package toward the canal of the ear through the aperture 440 of the soft ear interface 415.

FIG. 5 illustrates soft ear interface 515 with a plurality of baffles 550 arranged in a serpentine pattern, in accordance with an embodiment of the disclosure. Soft ear interface 515 is one possible implementation of soft ear interface 115 of ear-mountable listening device 101 illustrated in FIGS. 1A-1C and/or soft ear interface 215 illustrated in FIG. 2. Furthermore, it is appreciated that soft ear interface 515 may include the same or similar features of soft ear interface 415.

Soft ear interface 515 includes the plurality of baffles 515 that form a serpentine pattern on an outer surface 521 of the soft ear interface 515. In the illustrated embodiment, the serpentine pattern extends between a proximal end 595 and a distal end 590 of the soft ear interface 515. The serpentine pattern is characterized as including a plurality of inflections 561 in which directionality of a given baffle included in the plurality of baffles 550 changes to form one or more channels 560. For example, baffle 550-A and 550-B collectively define channel 560-A included in the one or more channels 560. A width and path of channel 560-A is determined by both the directionality and separation distance between baffles 560-A and 560-B. Similarly, baffles 550-B and 550-C define channel 560-B, which is adjacent to channel 560-A. In other words, the serpentine pattern of the plurality of baffles 550 forms at least two adjacent circuitous channels.

In the illustrated embodiment, the pathway formed by the channels 560-A and 560-B extend longitudinally from the proximal end 595 to the distal end 590 while simultaneously extending around approximately a quarter of the circumference of the soft ear interface 515. In other embodiments, the one or more channels may extend at least a half, three-quarters, or even a variable amount around the circumference of the soft ear interface 515 while extending longitudinally. In other embodiments, there may be multiple distinct serpentine patterns that wrap completely around the circumference of the soft ear interface 515.

The processes explained above are described in terms of computer software and hardware. The techniques described may constitute machine-executable instructions embodied within a tangible or non-transitory machine (e.g., computer) readable storage medium, that when executed by a machine will cause the machine to perform the operations described. Additionally, the processes may be embodied within hardware, such as an application specific integrated circuit ("ASIC") or otherwise.

A tangible machine-readable storage medium includes any mechanism that provides (i.e., stores) information in a non-transitory form accessible by a machine (e.g., a computer, network device, personal digital assistant, manufacturing tool, any device with a set of one or more processors, etc.). For example, a machine-readable storage medium includes recordable/non-recordable media (e.g., read only memory (ROM), random access memory (RAM), magnetic disk storage media, optical storage media, flash memory devices, etc.).

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in the following claims should not be construed to limit the invention to the specific embodiments disclosed in the specification. Rather, the scope of the invention is to be determined entirely by the following claims, which are to be construed in accordance with established doctrines of claim interpretation.

What is claimed is:

1. An ear-mountable listening device, comprising:

a soft ear interface shaped to house one or more components of the ear-mountable listening device, the soft ear interface having an outer surface that contacts a canal of an ear when the ear-mountable listening device is worn by the ear, wherein the outer surface of the soft ear interface includes a plurality of baffles to form one or more channels for air or moisture to propagate through, wherein the one or more channels extend between a distal end and a proximal end of the soft ear interface, and wherein the proximal end of the soft ear interface extends to at least a first bend of the canal and the distal end of the soft ear interface contacts a concha of the ear when the ear-mountable listening device is worn;

an acoustic package disposed, at least in part, within the soft ear interface to emit audio in response to an audio signal, and electronics coupled to the acoustic package, the electronics including logic that when executed by the electronics causes the ear-mountable listening device to perform operations including:

emitting the audio from the acoustic package toward the canal of the ear through an aperture of the soft ear interface formed proximate to the proximal end of the soft ear interface.

2. The ear-mountable listening device of claim 1, wherein a first channel included in the one or more channels has a length greater than a longitudinal length of the soft ear interface extending from the proximal end to the distal end.

3. The ear-mountable listening device of claim 1, wherein the plurality of baffles includes embossed rings extending, at least in part, circumferentially around the soft ear interface.

4. The ear-mountable listening device of claim 3, wherein the embossed rings are open rings with corresponding gaps, each formed by an opening of an individual ring included in the embossed rings, and wherein the corresponding gaps of adjacent rings are offset from one another such that there is not a straight line path between any three successive rings included in the embossed rings.

5. The ear-mountable listening device of claim 3, wherein a separation distance between adjacent rings is uniform and less than 1 mm.

6. The ear-mountable listening device of claim 3, wherein the embossed rings include a first ring and a second ring, and wherein a second bend of the ear canal is disposed between the first ring and the second ring when the ear-mountable listening device is worn.

7. The ear-mountable listening device of claim 1, wherein the plurality of baffles forms a serpentine pattern on the outer surface of the soft ear interface such that the one or more channels include at least two adjacent circuitous channels.

8. The ear-mountable listening device of claim 1, wherein the one or more channels are structured to wick moisture from within the ear canal towards a tragus of the ear via capillary action.

9. The ear-mountable listening device of claim 1, wherein the soft ear interface is further shaped to include at least one desiccant channel disposed between the outer surface and an inner surface of the soft ear interface, wherein the desiccant channel includes at least a first opening and a second opening at the outer surface of the soft ear interface, and wherein the first opening and the second opening are respectively disposed proximate to the proximal end and the distal end of the soft ear interface.

10. The ear-mountable listening device of claim 9, wherein the second opening is disposed proximate to a tragus of the ear when the ear-mountable listening device is worn.

11. The ear-mountable listening device of claim 9, wherein the soft ear interface is further shaped to include a plurality of collection points, disposed between the first opening and the second opening, that couple the outer surface of the soft ear interface to the at least one desiccant channel, and wherein each of the plurality of collection points form a corresponding secondary channel extending from the outer surface to the at least one desiccant channel.

12. The ear-mountable listening device of claim 11, wherein the corresponding secondary channel of at least one of the plurality of collection points is interconnected with the one or more channels formed by the plurality of baffles.

13. The ear-mountable listening device of claim 1, wherein at least one of the one or more channels extends to the concha or a saddle point of the ear when the ear-mountable listening device is worn.

14. The ear-mountable listening device of claim 1, wherein the soft ear interface is structured to provide an occlusive fit of the ear-mountable listening device to the ear such that the one or more channels are sealed by the ear when the ear-mountable listening device is worn.

15. The ear-mountable listening device of claim 1, wherein the one or more channels form a continuous and tortuous pathway between the distal end and the proximal end of the soft ear interface to provide a high impedance barrier to sound waves while still allowing equalization between an ambient pressure and a middle ear pressure when the ear-mountable listening device is worn.

16. The ear-mountable listening device of claim 1, wherein a portion of the outer surface of the soft ear interface that forms the one or more channels includes a hydrophilic material.

17. A soft ear interface for an ear-mountable listening device, comprising:

a first segment shaped to be inserted into a canal of an ear and extending to at least a first bend of the canal, wherein the first segment includes an aperture corresponding to a proximal end of the soft ear interface;

a second segment extending from the first segment and shaped to house, at least in part, one or more components of the ear-mountable listening device, the second segment forming a distal end of the soft ear interface and further shaped to contact a concha of the ear when the ear-mountable listening device is worn, wherein the first segment and the second segment collectively form an outer surface of the soft ear interface, wherein the outer surface of the soft ear interface includes a plurality of baffles to form one or more channels for air or moisture to propagate through, and wherein the one or more channels extend between the distal end and the proximal end of the soft ear interface.

18. The soft ear interface of claim 17, wherein a first channel included in the one or more channels has a length greater than a longitudinal length of the soft ear interface extending from the proximal end to the distal end.

19. The soft ear interface of claim 17, wherein the plurality of baffles includes embossed rings extending, at least in part, circumferentially around the soft ear interface, wherein the embossed rings are open rings with corresponding gaps, each formed by an opening of an individual ring included in the embossed rings, and wherein the corresponding gaps of adjacent rings are offset from one another such that there is not a straight line path between any three successive rings included in the embossed rings.

20. The soft ear interface of claim 17, wherein the plurality of baffles includes embossed rings extending, at least in part, circumferentially around the soft ear interface, wherein the embossed rings include a first ring and a second ring, and wherein a second bend of the ear canal is disposed between the first ring and the second ring when the ear-mountable listening device is worn.

21. The soft ear interface of claim 17, wherein the plurality of baffles forms a serpentine pattern on the outer surface of the soft ear interface such that the one or more channels include at least two adjacent circuitous channels.

22. The soft ear interface of claim 17, wherein the soft ear interface is further shaped to include at least one desiccant channel disposed between the outer surface and an inner surface of the soft ear interface, wherein the desiccant channel includes at least a first opening and a second opening at the outer surface of the soft ear interface, and wherein the first opening and the second opening are respectively disposed proximate to the proximal end and the distal end of the soft ear interface.

23. The soft ear interface of claim 22, wherein the soft ear interface is further shaped to include a plurality of collection points, disposed between the first opening and the second opening, that couple the outer surface of the soft ear interface to the at least one desiccant channel, and wherein each of the plurality of collection points form a corresponding secondary channel extending from the outer surface to the at least one desiccant channel.

24. The soft ear interface of claim 23, wherein the corresponding secondary channel of at least one of the plurality of collection points is interconnected with the one or more channels formed by the plurality of baffles.

* * * * *